United States Patent [19]

Diaz

[11] Patent Number: 4,893,486

[45] Date of Patent: Jan. 16, 1990

[54] FLOW-INTENSIFYING APPARATUS FOR CLOTHES WASHER

[75] Inventor: Guillermo Diaz, Dover, N.J.

[73] Assignee: Agriworld Corp., Union, N.J.

[21] Appl. No.: 382,714

[22] Filed: Jul. 19, 1989

[51] Int. Cl.[4] ..... D06F 17/10

[52] U.S. Cl. ..... 68/18 FA; 68/122; 68/134

[58] Field of Search ..... 68/18 FA, 28, 54, 122, 68/123, 125, 134, 212, 213, 235 R, 132, 133

[56] References Cited

U.S. PATENT DOCUMENTS 3,376,718 4/1968 Kahn ..... 68/133 X 4,159,632 7/1979 Grantham ..... 68/125 X

*Primary Examiner*—Philip R. Coe

*Attorney, Agent, or Firm*—Amster, Rothstein & Ebenstein

[57] ABSTRACT

A flow-intensifier for use in an upright automatic clothes washing machine includes a weight disposed intermediate the washer agitator and the washer drum, non-extendible elongate connectors operatively connected at one end to the agitator for movement therewith and at the other end to the weight for movement therewith, and a redirecting guide traversed by the connector and operatively connected to the drum for movement therewith so that reciprocal relative rotation of the agitator and the drum causes a corresponding reciprocal vertical movement of the weight.

26 Claims, 4 Drawing Sheets

FLOW-INTENSIFYING APPARATUS FOR CLOTHES WASHER

BACKGROUND OF THE INVENTION

The present invention relates to automatic clothes washing machines, and more particularly to apparatus for intensifying the flow within an upright automatic clothes washing machine.

The standard upright automatic clothes washing machine includes a central vertically oriented agitator, a hollow cylindrical drum coaxially disposed about the agitator, and means for reciprocally rotating the agitator and the drum relative to each other about a vertical axis during the washing cycle. The washing machine may additionally include means for rotating the agitator and drum together as a unit about the vertical axis during the spin cycle. Typically during the washing cycle the drum is stationary and the agitator reciprocally rotates about the vertical axis to effect relative movement between the clothing to be washed and the water in the drum which flows through clothing to remove therefrom soil (including dirt and similar accumulations on or within the clothing). The stronger or more forceful the flow of water through the clothing, the more likely it is that the water will be able to remove the soil. Indeed, this is the basis for such antiquated (although still used) manual techniques as wetting clothing in a running stream and then banging the clothing on rocks to force the water through and out of the clothing. A slightly modified version of this antiquated technique is still widely practiced—namely, rubbing wet clothing against the irregular surface of a washing board. Each of these manual techniques causes water to pass through the fibers of the clothing to remove the soil therefrom.

The action of the agitator and drum during the washing of a modern upright automatic clothes washing machine is adequate to cause some reciprocal, substantially lateral motion of the clothing from one side to another relative to the water in the drum, but this relative water flow does not effect sufficient wringing pressure to effect a desirably continuous cycle of water-absorption and water-expulsion. More precisely, the pressure with which the water is forced through the clothing in the automatic washing machine is less than the pressure typically exerted in manual washing. Accordingly, the modern washing machine requires the use of stronger detergents, larger amounts of detergent, or repeated washings, each of which not only increases the cost of the washing operation but may also be detrimental to the clothing—that is, over time may cause the clothing to become dingy or yellowed and eventually to deteriorate.

Accordingly, it is an object of the present invention to provide apparatus for intensifying the relative flow between water and clothing in the washing cycle of an upright automatic clothes washing machine.

Another object is to provide such apparatus which may be added to existing washing machines.

A further object is to provide such apparatus which increases the pressure with which the water flows through the clothing during the washing cycle.

SUMMARY OF THE INVENTION

It has now been found that the above and related objects of the present invention are obtained in a flow-intensifier for use in an upright automatic clothes washing machine. The upright automatic clothes washing machine has a central vertically oriented agitator, a hollow cylindrical drum coaxially disposed about the agitator, and means for reciprocally rotating the agitator and the drum relative to each other about a vertical axis during the washing cycle. The flow-intensifying apparatus comprises weighted means adapted to be disposed intermediate the agitator and the drum, and non-extendible elongate means adapted to be operatively connected at one end to the agitator for movement therewith and at the other end to the weighted means for movement therewith. Redirecting means adapted to be traversed by the elongate means are operatively connected to the drum for movement therewith so that the reciprocal relative rotation of the agitator and the drum causes a corresponding reciprocal vertical movement of the weighted means.

In a preferred embodiment, the weighted means is water-impermeable and not water-absorbent, and the elongate means is flexible. The washing machine may include a strainer disposed on the agitator for reciprocal rotation therewith relative to the drum, the one end of the elongate means being adapted to be operatively connected to the strainer for movement therewith. The elongate means and the redirecting means are configured and dimensioned so that the weighted means is disposed radially outwardly of the agitator, thereby to avoid being driven horizontally by abutting contact with the agitator below the level of the redirecting means as the agitator reciprocally rotates relative to the drum.

Preferably the apparatus includes a plurality (preferably, four) of the weighted means, a like plurality of the redirecting means, and a like plurality of the elongate means. Each of the elongate means is adapted to be operatively connected at one end to a respective one of the weighted means, at the other end to the agitator, and to traverse a respective one of the redirecting means. Thus reciprocal rotation of the agitator relative to the drum causes a corresponding reciprocal vertical movement of each of the weighted means. The plurality of redirecting means are adapted to be operatively connected to the drum in a circumferentially spaced configuration relative to the agitator such that the reciprocal rotation of the agitator relative to the drum causes a corresponding reciprocal vertical movement of each of the weighted means. Each of the weighted means is reciprocally vertically moved in phase.

The present invention also encompasses a conventional upright automatic clothes washing machine including such flow intensifying apparatus.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
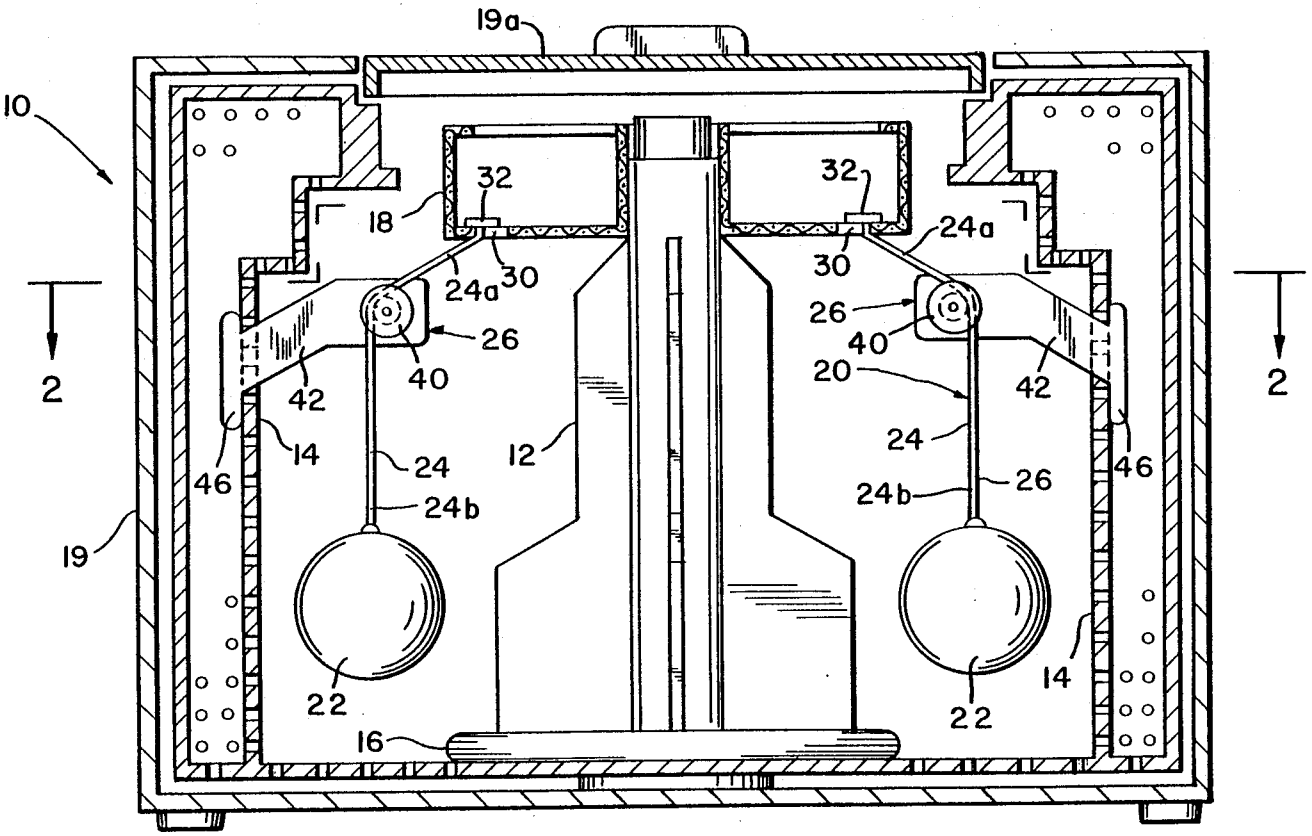
FIG. 1 is a side elevational view, partially in cross section, of an upright automatic clothes washing machine incorporating a flow-intensifier according to the present invention.
Figure 2:
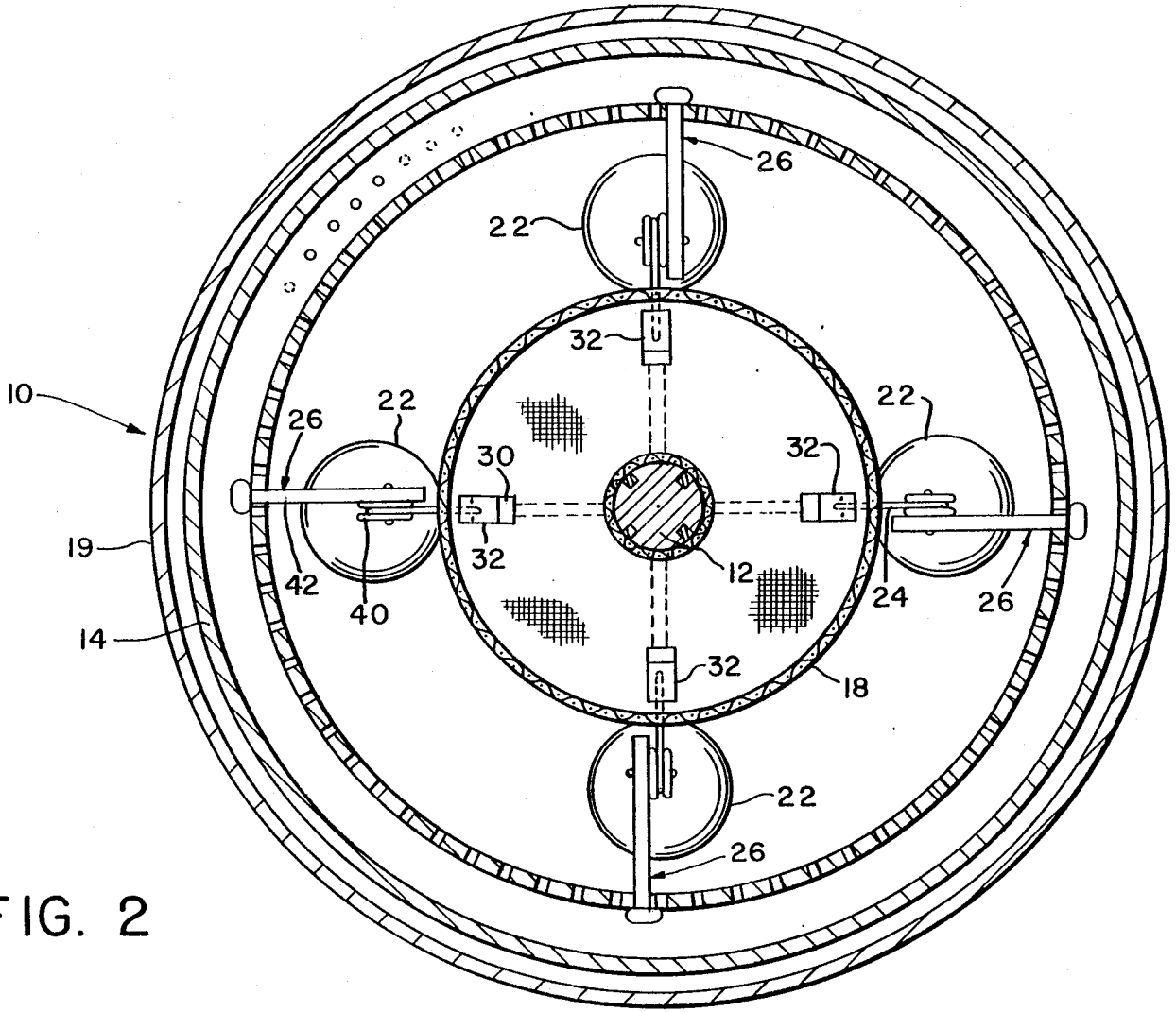
FIG. 2 is a top plan sectional view taken along the line 2—2 of FIG. 1.

Referring now to the drawing, and in particular to FIGS. 1 and 2 thereof, therein illustrated is a conventional upright automatic clothes washing machine, generally designated by the reference numeral 10, including a central vertically oriented agitator 12, a foraminous hollow cylindrical drum 14 coaxially disposed about the agitator 12, and drive means 16. The drive means 16 reciprocally rotates the agitator 12 and the drum 14 relative to each other about a vertical axis during the washing cycle (typically reciprocally rotating the agitator relative to a stationary drum) and rotates the agitator 12 and drum 14 together as a unit about the vertical axis during the spin dry cycle. A water filter and/or lint remover, hereinafter referred to as the strainer 18, is secured to the top of the agitator 12 for rotation therewith as a unit. The water filter/lint remover strainer 18 is in the form of a foraminous basket through which the fresh water passes as it enters the drum 14 initially and/or the wash water passes during the wash cycle. The strainer 18 is typically removable from the agitator 12 for cleaning, although it may also be permanently affixed to and constitute a part of the agitator 12. The various components 12, 14, 16, 18 are disposed in a stationary housing 19 having an upwardly pivotable lid 19*a*. As the upright automatic clothes washing machine described thus far is conventional in structure and operation, and well known to those skilled in the art, further details need not be provided herein.

The novel apparatus of the present invention intensifies the flow of water through the clothing during the wash cycle, when the drive means 16 is rotating the agitator 12 and the drum 14 relative to each other about a vertical axis. The flow-intensifying apparatus, generally designated 20, comprises weighted means 22, adapted to be disposed intermediate the agitator 12 and the drum 14, non-extendible elongate means 24 adapted to be operatively connected at one end 24*a* to the agitator 12 for movement therewith and at the other 24*b* end to the weighted means 22 for movement therewith, and redirecting means generally designated 26 adapted to be traversed by the elongate means 22 and operatively connected to the drum 14 for movement therewith so that the reciprocal relative rotation of the agitator 12 and drum 14 causes a corresponding reciprocal vertical movement of the weighted means 22.

The elongate means 24 are preferably non-water absorbent, wear-resistant, rust-proof flexible cords made, for example, of a plastic material. Each cord 24 is operatively connected at its upper end 24*a* to the agitator 12 for movement therewith either directly (this being a likely situation where the flow-intensifying apparatus of the present invention is incorporated in original equipment washer) or by means of an attachment to the agitator 12 which rotates with the agitator (this being a likely situation where the flow-intensifying apparatus is a separately purchased or "after market" piece of equipment). For example, the cord upper end 24*a* may be secured to the strainer 18 which is positioned atop of agitator 12 for rotation therewith as a unit.

The cord upper end 24*a* is preferably removably connected to the agitator 12 or strainer 18. For example, in original equipment the strainer 18 (as illustrated) or agitator 12 may be provided with a radially elongate slot 30 adapted to engage the T-shaped head 32 at the upper end of cord 24. The head 32 of the cord 24 can easily be inserted through the slot 30, but, once inserted therethrough and repositioned as illustrated, as will be apparent hereinafter, it is maintained in a position precluding accidental return passage therethrough by the natural forces exerted on cord 24. The cord 24 remains easily separable from the slot 30, however, by simply forcibly repositioning and realigning the head 32 with the slot 30 and then passing the head 32 through the slot 30. In add-on equipment, the upper end of the cord 24 may be provided with any of a variety of available fastening elements which will removably secure the cord 24 and the strainer 18 or agitator 12 (e.g., by hooking onto the foramina or apertures of the strainer 18). A variety of alternative means may be provided for removably securing the cord upper end 24*a* to the foraminous strainer 18 or the agitator 12 for rotation therewith as a unit. The removable nature of the connection between the cord upper end 24*a* and the strainer 18 or agitator 12 facilitates removal of the strainer 18 for cleaning thereof and enables deactuation of the flow-intensifying apparatus 20 so that a less tense flow may be provided for use in washing delicate materials such as lingerie without necessitating removal of the entire flow-intensifying apparatus 20 from the washing machine 10.

Preferably the cord upper end 24*a* is configured and dimensioned so that it will not pass through the redirecting means 26 so that, even if the cord upper end is detached from the agitator 12 or strainer 18, it does not separate from its redirecting means 26 and remains easily accessible for reconnection to the agitator or strainer.

The cord 24 extends outwardly from agitator 12 and passes through redirecting means 26, which converts generally horizontal movement of the cord upper end 24*a* into generally (and preferably substantially) vertical movement of the cord lower end 24*b*. Redirecting means 26 is a block including a pulley 40 and a casing 42 in which the pulley 40 is freely rotatable. The block 26 is formed of non-water absorbent, rust-proof, wear-resistant materials such as plastic, rust-proof metal or the like. The block 26 is secured to the drum 14 for rotation therewith as a unit. When the flow-intensifying apparatus 20 of the present invention is included in the original equipment manufacture washing machine, the casing 42 may be welded, cemented or otherwise permanently secured to the drum 14. When the flow-intensifying apparatus is after market equipment intended to be added to an existing washing machine, the casing 42 is provided with means for easily securing the same to the drum 14. For example, the casing 42 may be provided with a T-shaped enlarged head 46 adapted to be passable in one orientation through one of the apertures of the foraminous sidewal of the drum 14 and then reoriented by the natural forces exerted thereon, as will become apparent hereinafter, to preclude accidental passage back through the one aperture. Head 46 is configured and dimensioned so that it does not interfere with rotation of the drum 14 relative to the housing 19 of the washing machine during the spin cycle, yet affords a sufficiently secure attachment that the block 26 is not accidentally displaced from the drum 14. Clearly a variety of different fastening means may be used to secure the block 26 to the drum 14. For example, the head 46 may be a hook having a curved free end which can enter one aperture of the drum sidewall in one direction and return through an adjacent aperture in the opposite direction. The block 26 may be permanently secured to the drum 14 for rotation therewith as a unit or, if desired, only removably secured to the drum 14 so that the entire flow-intensifying apparatus 20 may be easily removed from the washing machine 10, for example, to facilitate repair of the machine or to enlarge the load capacity of the machine (that is, the volume of clothing which can be washed in a given operation) when flow intensification is not required.

Redirecting means other than a block 26 having a pulley 40 and casing 42 may be employed to redirect the generally horizontal motion of the cord upper end 24*a* into the generally (and preferably substantially) vertical motion of the cord lower end 24*b*. While it is preferred that the cord 24 pass over a freely rotatable element such as the pulley 40 in order to minimize wear on the cord 24, a pulley-free block having a low friction arcuate channel for transverse by the cord may be used to accomplish the same function.

The lower end 24*b* of cord 24 is secured to a weighted means such as weight 22. The weight 22 is formed of a dense, non-water absorbent, rust-proof, wear-resistant material such as plastic, lead or the like. The weight 22 is preferably spherical, although clearly other configurations may also be used advantageously in the practice of the present invention provided that the configuration does not result in undue wear on the material being washed or the remainder of the washing machine 10. Generally, sharp edges which may cause tearing of the material being washed should be avoided. For maximum flow intensification, the weight 22 is preferably substantially inflexible, imperforate and water-impermeable so that it is capable of effecting a maximum displacement of water within the drum 14. Each weight 22, which may be hollow or solid, is preferably about 1.5–2.0 lbs. in weight.

The block 26 redirects the cord 24 extending from the agitator 12 over the pulley 40 so that the cord lower end 24*b* supports the weight 22 intermediate the vanes of the agitator 12 and the sidewall of drum 14. The weight 22 is preferably disposed radially outwardly of the vanes of agitator 12 to avoid the possibility of abutting contact with the agitator 12 below the level of the block 26 as the agitator 12 reciprocally rotates relative to the drum 14 during the wash cycle. Such abutting contact would result in the weight 22 being propelled by the agitator 12 in a direction having a strongly horizontal component, a motion not found necessary to effect the desired flow intensification and desirably avoided to prevent damage to the agitator, the drum, the weight, or all of them.

Weight 22 can be attached to the cord lower end 24*b* by conventional means depending upon the nature of the materials from which the cord and weight are formed. For example, the cord lower end may be secured to the weight by welding, cementing, crimping, friction fit, or the like. However the attachment must be sufficiently secure to withstand repeated vertical cycling of the weight and the need to move heavy waterlogged materials of the wash load out of the travel path of the rising weight.

While it has been noted that the upper end of the cord 24 is preferably removably secured to the agitator 12 or strainer 18 in order to facilitate deactivation of the flow-intensifying apparatus 20 for particular wash loads, alternatively or in addition thereto the lower end of the cord 24 may be detachable from the weight 22 so that the weight 22 may be removed from the drum 14 without disturbing the block 26 or cord 24 (which cord may then be removably or permanently secured to the agitator 12 or strainer 18, as desired). As still another possibility, the upper end of the cord 24 may be capable of passing through the block 26 upon detachment from the agitator 12 or strainer 18 so that the cord 24 and its attached weight 22 may be separated from the block 26 and lifted out of the drum 14.

Figure 3:
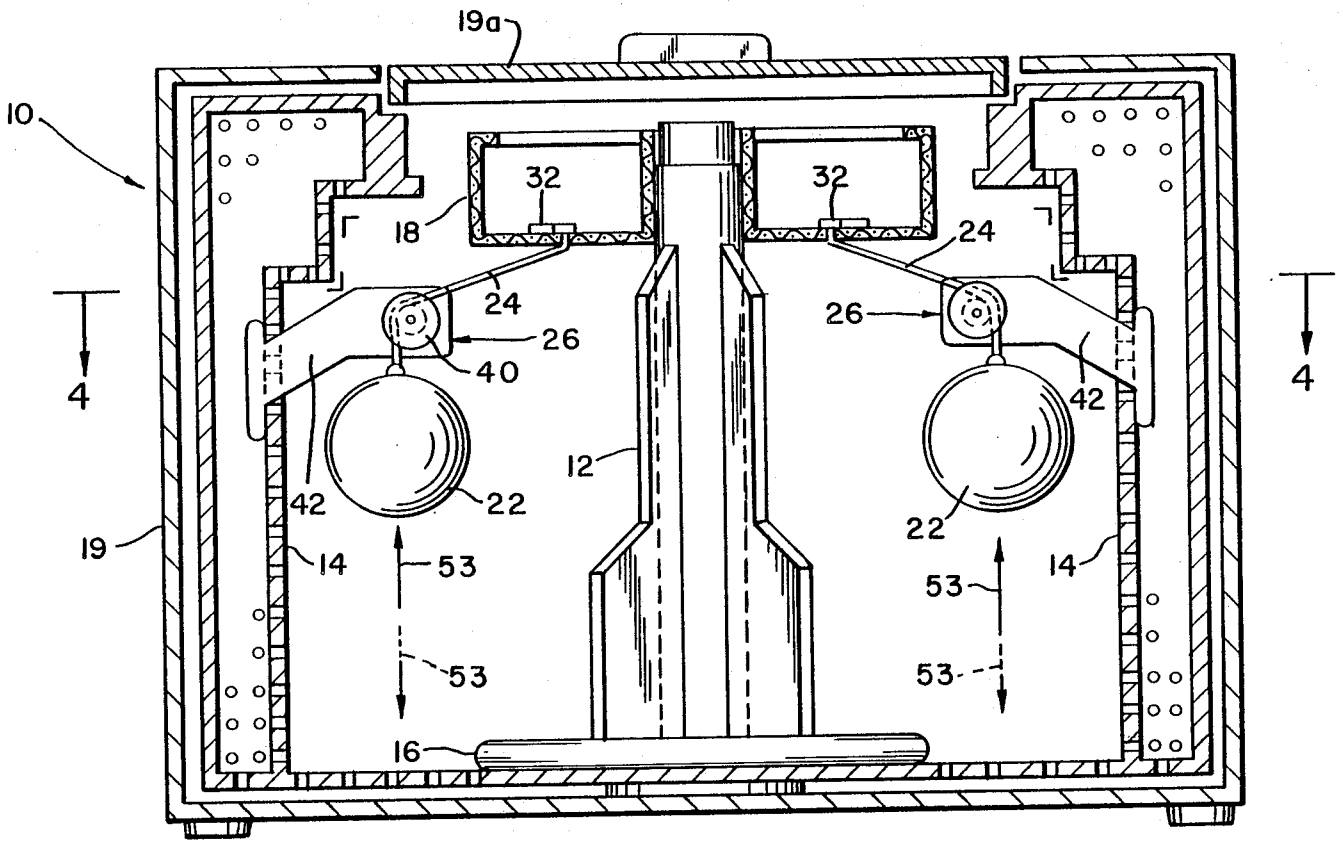
FIG. 3 is a view similar to FIG. 1, but showing the components thereof in a different relative orientation due to relative rotation between the agitator and the drum.
Figure 4:
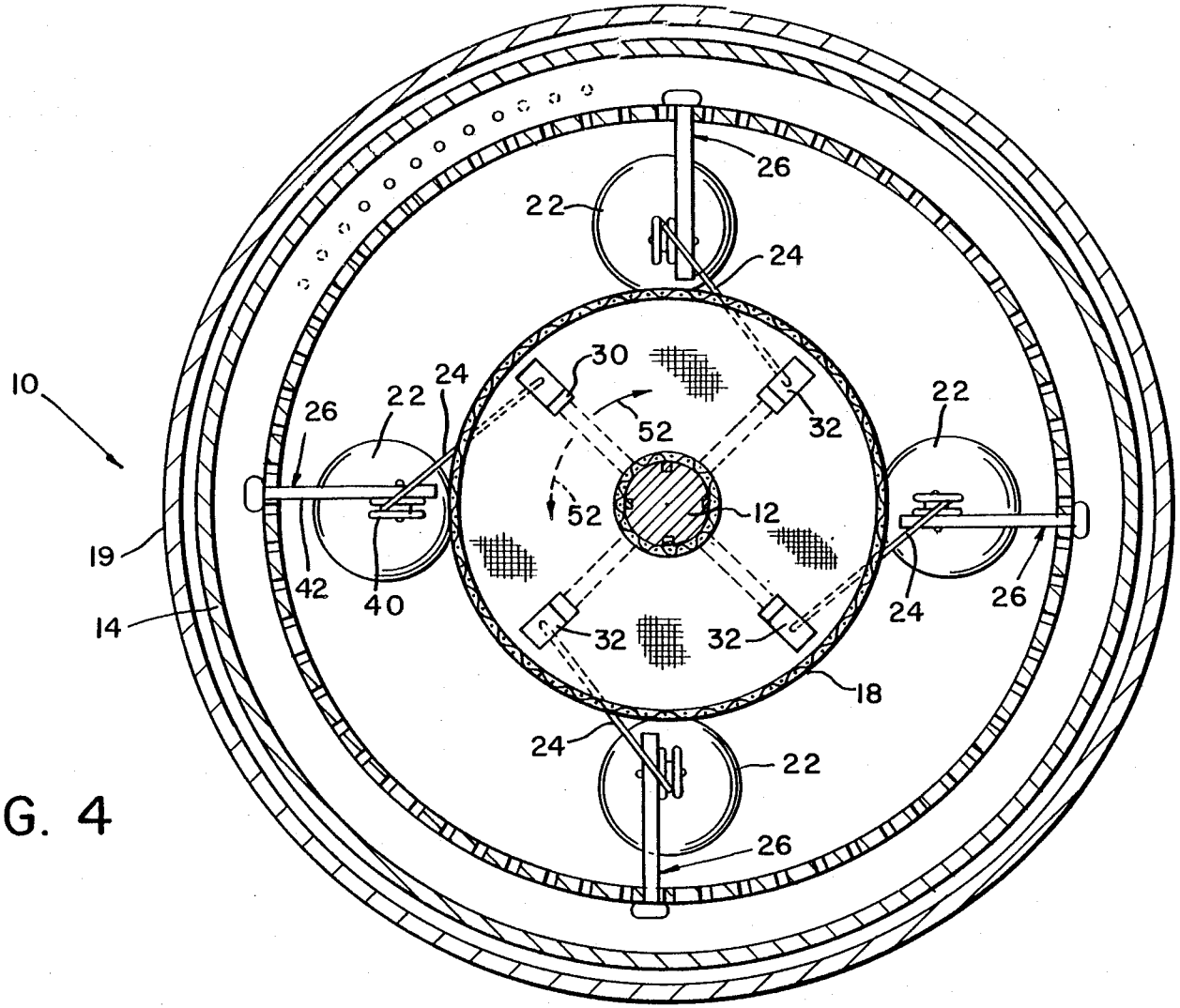
FIG. 4 is a top plan sectional view taken along the line 4—4 of FIG. 3.

Referring now to FIGS. 3 and 4 as well, as the agitator 12 rotates reciprocally in a horizontal plane relative to the drum 14 during the washing cycle, the reciprocal horizontal movement of the agitator 12 (indicated by arrows 52 of FIG. 4) is translated by the redirecting means 26 into a reciprocal vertical movement of the weight 22 in the gap between the vanes of the agitator 12 and the sidewall of the drum 14 (indicated by arrows 54 of FIG. 3). The vertical movement of the weight 22 imparts a vertical movement to the wash water which intensifies the flow of the wash water through the wash load in the drum 14 during the wash cycle. The vertical component of the fluid flow within the drum 14 resulting from the vertical movement of the weight 22 supplements the horizontal component of the fluid flow within the drum 14 resulting from the horizontal movement of the vanes of the agitator 12. The flow intensifying apparatus 20 of the present invention further supplements the agitator 12 by enhancing the horizontal component of the fluid flow as that portion of the wash water which cannot be moved vertically by the vertically moving weight 22 is necessarily jetted outwardly horizontally by the action of the weight 22.

In the preferred embodiment of the present invention, the flow-intensifying apparatus 20 includes a plurality of the weights 22, a like plurality of the blocks 26 and a like plurality of the cords 24, each of the cords 24 being adapted to be operatively connected at one end 24*b* to a respective one of the weights 22 and at the other end 24*a* to the agitator 12, and to traverse a respective one of the blocks 26 so that reciprocal horizontal rotation of the agitator 12 relative to the drum 14 causes a reciprocal vertical movement of the respective weight 22. Depending upon the size of the washing machine 10, a plurality of 2, 3, 4 or even more of each of the weights 22, cords 24, and blocks 26 may be used. As illustrated, for home use a plurality of 4 is preferred to provide a desired level of flow intensification without unduly diminishing the wash load holding capacity of the drum 14. The cord upper ends 24*a* are fixed to circumferentially spaced points on or adjacent the outer circumference of the agitator 12 or strainer 18, and the blocks 26 are operatively connected to the drum 14 in a circumferentially spaced configuration such that the reciprocal horizontal rotation of the agitator 12 relative to the drum 14 causes a corresponding reciprocal vertical movement of each of the weights 22.

In the preferred embodiment of the present invention the blocks 26 are commonly disposed relative to the attachment points of the cords 24 to the agitator 12 (or strainer 18), so that for any given position of the agitator 12 within the drum 14 the blocks 26 are either all in radial alignment with the respective attachments points (see FIGS. 1 and 2) or similarly angularly displaced therefrom (see FIGS. 3 and 4), whether angularly advanced or behind the attachment points. In such an arrangement, each of the weights 22 is reciprocally vertically moved in phase with one another—all going up and going down together. For particular applications, however, it may be desirable to have the weights 22 move out of phase with one another, for example, with one set of alternate weights moving upwardly together and concurrently one set of alternate weights moving downwardly together. Such motion is accomplished by displacing alternate blocks 26 to opposite angular displacements from the points of attachment such that, for any given position of the agitator 12 where the attachment points are not aligned with the blocks, one block 26 is slightly ahead of its attachment point in the clockwise direction while the two immediately adjacent blocks 26 (one on either side of the intermediate block) are slightly behind their attachment points in the counterclockwise direction. Subsequent clockwise rotation of the agitator 12 relative to the drum 14 causes the weight 22 attached to the cord 24 passing through the one block 26 to drop as the two weights 22 attached to the cords 24 passing through the adjacent blocks 26 lift.

The blocks 26 are preferably disposed in, adjacent to, or above the horizontal plane of the attachment points of the cords 24 and the agitator 12 so that the wash load does not impact upon the segments of the cords 24 between their attachment points and their respective blocks 26. Such impact would undesirably interfere with the desired cyclical movements of the weighted means 22 and at the same time impede the normal agitation of the wash load.

The flow-intensifying apparatus of the present invention may be incorporated in original equipment washing machines, as illustrated and described above, or provided in a kit form permitting it to be easily and rapidly employed to modify or convert an existing washing machine. Such a kit would typically include the weighted means, the elongate means, and the redirecting means. Additionally, the kit might include an instruction booklet for assembly and use of the flow intensifier and the incidental hardware (for example, screws) necessary to attach the redirecting means to the drum and possibly the connecting means to the agitator or strainer. Typically, although not necessarily, the kit would include equal numbers of the weighted means, the connecting means, and the redirecting means. For use with washers not having a water filter/lint remover strainer secured atop the agitator, the kit may include a member, analogous to the strainer, intended to be secured to the top of the agitator for rotation therewith and to receive the upper ends of the connecting means.

The flow-intensifying apparatus operates automatically, with the normal action of the agitator relative to the drum during the wash cycle automatically causing the desired reciprocal vertical movement of the weights. Should it be desired to deactivate the flow-intensifying apparatus for a particular wash load, one has only to detach the upper ends of the cords from the agitator or strainer and the weights will simply lie on the bottom of the drum. If desired, alternatively the casings may be disconnected from the drum to enable removal of the cords, blocks and weights from the drum so as to maximize the available volume therein for a wash load. Alternatively, the blocks may be left attached to the drum and the cords separated from the blocks to permit removal of the cords and weights without removal of the blocks. As yet another alternative, the weights may be disconnected from the cords and removed from the drum while leaving the cords and blocks in place within the drum.

To summarize, the present invention provides apparatus for intensifying the relative flow between water and the wash load during the washing cycle of an upright automatic clothes washing machine by increasing the pressure with which the water flows through the wash load. The apparatus may be provided as original equipment manufacture or after market equipment Flow-intensifying apparatus of the present invention provides superior cleaning of the wash load while at the same time reducing the cost thereof (by eliminating the need for excessive amounts of detergent and enabling the use of a shorter wash cycle) and reducing harm to the wash load (because strong detergents and repeated washings are not required, thereby lessening wear and yellowing of the wash load).

Now that the preferred embodiments of the present invention have been shown and described in detail, various modifications and improvements thereon will become readily apparent to those skilled in the art. Accordingly, the appended claims are to be construed broadly and in a manner consistent with the spirit and scope of the invention herein.

I claim:

1. Flow-intensifying apparatus for use in an upright automatic clothes washing machine having a central vertically oriented agitator, a hollow cylindrical drum coaxially disposed about the agitator, and means for reciprocally rotating the agitator and the drum relative to each other about a vertical axis during the washing cycle, said flow-intensifying apparatus comprising:

(A) weighted means adapted to be disposed intermediate the agitator and the drum;

(B) non-extendible elongate means adapted to be operatively connected at one end to the agitator for movement therewith and at the other end to said weighted means for movement therewith;

(C) redirecting means adapted to be traversed by said elongate means and operatively connected to the drum for movement therewith so that the reciprocal relative rotation of the agitator and the drum causes a corresponding reciprocal vertical movement of said weighted means.

2. The apparatus of claim 1 wherein said weighted means is not water-absorbent.

3. The apparatus of claim 1 wherein said weighted means is water-impermeable.

4. The apparatus of claim 1 wherein said elongate means is flexible.

5. The apparatus of claim 1 wherein the washing machine includes a strainer disposed on the agitator for reciprocal rotation therewith relative to the drum, and said one end of said elongate means is adapted to be operatively connected to said strainer for movement therewith.

6. The apparatus of claim 1 including a plurality of said weighted means, a like plurality of said redirecting means, and a like plurality of said elongate means, each of said elongate means being adapted to be operatively connected at one end to a respective one of said weighted means, at the other end to the agitator, and to traverse a respective one of said redirecting means, whereby reciprocal rotation of the agitator relative to the drum causes a corresponding reciprocal vertical movement of each of said weighted means.

7. The apparatus of claim 6 wherein said plurality of redirecting means are adapted to be operatively connected to the drum in a circumferentially spaced configuration relative to the agitator such that the reciprocal rotation of the agitator relative to the drum causes a corresponding reciprocal vertical movement of each of said weighted means.

8. The apparatus of claim 7 wherein said plurality is four.

9. The apparatus of claim 7 wherein each of said weighted means is reciprocally vertically moved in phase.

10. The apparatus of claim 6 wherein said elongate means and said redirecting means are configured and dimensioned so that each of said weighted means is disposed radially outwardly of the agitator, thereby to avoid being driven horizontally by abutting contact with the agitator below the level of said redirecting means as the agitator reciprocally rotates relative to the drum.

11. Upright automatic clothes washing machine apparatus comprising:

(A) a central vertically oriented agitator;

(B) a hollow cylindrical drum coaxially disposed about said agitator;

(C) means for reciprocally rotating said agitator and said drum relative to each other about a vertical axis during the washing cycle;

(D) weighted means disposed intermediate said agitator and said drum;

(E) non-extendible elongate means operatively connected at one end to said agitator for movement therewith and at the other end to said weighted means for movement therewith; and (F) redirecting means traversed by said elongate means and operatively connected to said drum for movement therewith so that the reciprocal relative rotation of said agitator and said drum causes a corresponding reciprocal vertical movement of said weighted means.

12. The apparatus of claim 11 wherein said weighted means is not water-absorbent.

13. The apparatus of claim 11 wherein said weighted means is water-impermeable.

14. The apparatus of claim 11 wherein said elongate means is flexible.

15. The apparatus of claim 11 wherein the washing machine includes a strainer disposed on the agitator for reciprocal rotation therewith relative to the drum, and said one end of said elongate means is adapted to be operatively connected to said strainer for movement therewith.

16. The apparatus of claim 11 including a plurality of said weighted means, a like plurality of said redirecting means, and a like plurality of said elongate means, each of said elongate means being adapted to be operatively connected at one end to a respective one of said weighted means, at the other end to the agitator, and to traverse a respective one of said redirecting means, whereby reciprocal rotation of the agitator relative to the drum causes a corresponding reciprocal vertical movement of each of said weighted means.

17. The apparatus of claim 16 wherein said plurality of redirecting means are adapted to be operatively connected to the drum in a circumferentially spaced configuration relative to the agitator such that the reciprocal rotation of the agitator relative to the drum causes a corresponding reciprocal vertical movement of each of said weighted means.

18. The apparatus of claim 17 wherein said plurality is four.

19. The apparatus of claim 17 wherein each of said weighted means is reciprocally vertically moved in phase.

20. The apparatus of claim 16 wherein said elongate means and said redirecting means are configured and dimensioned so that each of said weighted means is disposed radially outwardly of the agitator, thereby to avoid being driven horizontally by abutting contact with the agitator below the level of said redirecting means as the agitator reciprocally rotates relative to the drum.

21. Upright automatic clothes washing machine apparatus comprising:

(A) a central vertically oriented agitator;

(B) a hollow cylindrical drum coaxially disposed about said agitator;

(C) means for reciprocally rotating said agitator and said drum relative to each other about a vertical axis during the washing cycle;

(D) a plurality of weighted means disposed intermediate said agitator and said drum, said weighted means being water-impermeable and not water-absorbent;

(E) a like plurality of non-extendible flexible elongate means, each of said elongate means being operatively connected at one end to said agitator for movement therewith and at the other end to one of said weighted means for movement therewith; and (F) a like plurality of redirecting means, each of said redirecting means being traversed by a respective one of said elongate means and being operatively connected to said drum for movement therewith, so that the reciprocal relative rotation of said agitator and said drum causes a corresponding reciprocal vertical movement of each of said weighted means, said plurality of redirecting means being operatively connected to said drum in a circumferentially spaced configuration relative to said agitator.

22. The apparatus of claim 21 additionally including a strainer disposed on said agitator for reciprocal rotation therewith relative to said drum, said one end of each of said elongate means being operatively connected to said strainer for movement therewith.

23. The apparatus of claim 21 wherein said plurality of redirecting means are adapted to be operatively connected to the drum in a circumferentially spaced configuration relative to the agitator such that the reciprocal rotation of the agitator relative to the drum causes a corresponding reciprocal vertical movement of each of said weighted means.

24. The apparatus of claim 21 wherein said plurality is four.

25. The apparatus of claim 21 wherein each of said weighted means is reciprocally vertically moved in phase.

26. The apparatus of claim 21 wherein said elongate means and said redirecting means are configured and dimensioned so that each of said weighted means is disposed radially outwardly of the agitator, thereby to avoid being driven horizontally by abutting contact with the agitator below the level of said redirecting means as the agitator reciprocally rotates relative to the drum.

* * * * *